US006059930A

United States Patent [19]

Wong Shing et al.

[11] Patent Number: 6,059,930

[45] Date of Patent: May 9, 2000

[54] PAPERMAKING PROCESS UTILIZING HYDROPHILIC DISPERSION POLYMERS OF DIMETHYLAMINOETHYL ACRYLATE METHYL CHLORIDE QUATERNARY AND ACRYLAMIDE AS RETENTION AND DRAINAGE AIDS

[75] Inventors: Jane B. Wong Shing, Aurora; John R. Hurlock, Hickory Hills, both of Ill.

[73] Assignee: Nalco Chemical Company, Naperville, Ill.

[21] Appl. No.: 09/015,752

[22] Filed: Jan. 30, 1998

Related U.S. Application Data

[63] Continuation-in-part of application No. 08/719,283, Sep. 24, 1996, abandoned.

[51] Int. Cl.[7] ..... D21H 21/10

[52] U.S. Cl. ..... 162/168.2; 162/168.3; 162/175; 162/183

[58] Field of Search ..... 162/168.3, 168.2; 210/723, 734, 175, 183

[56] References Cited

U.S. PATENT DOCUMENTS 4,388,150 6/1983 Sunden et al. .
4,696,962 9/1987 Danner et al. .
4,753,710 6/1988 Langley et al. .
4,795,531 1/1989 Sofia et al. .
4,913,775 4/1990 Langley et al. .
4,929,655 5/1990 Takeda et al. .
5,006,590 4/1991 Takeda et al. .
5,098,520 3/1992 Begala .
5,185,062 2/1993 Begala .
5,254,221 10/1993 Lowry et al. .
5,334,679 8/1994 Yamomoto et al. .
5,466,338 11/1995 Pearson .
5,587,415 12/1996 Takeda .

*Primary Examiner*—Peter Chin
*Attorney, Agent, or Firm*—Michael B. Martin; Thomas M. Breninger; Kelly L. Cummings

[57] ABSTRACT

A method for improving retention and drainage performance in a papermaking process is disclosed. The method comprises forming an aqueous cellulosic papermaking slurry, adding an effective amount of a hydrophilic dispersion polymer to the slurry, draining the slurry to form a sheet and drying the sheet. The hydrophilic dispersion polymer is preferably a copolymer of dimethylaminoethyl acrylate methyl chloride quaternary and acrylamide.

16 Claims, 5 Drawing Sheets

| Polymer Description | Cationic Mole% | DMAEA. MCQ Mole % | DMAEA. BCQ Mole % | IV 0.125N NO3 (dl/g) |
|---|---|---|---|---|
| Polymer A | 10 | 10 | 0 | 17.7 |
| Dispersion A | 3 | 3 | 0 | 12.1 |
| Dispersion B | 5 | 5 | 0 | 14.1 |
| Dispersion C | 10 | 10 | 0 | 14.8 |

| Polymer Description | Cationic Mole% | DMAEA. MCQ Mole % | DMAEA. BCQ Mole % | IV 0.125N NO3 (dl/g) |
|---|---|---|---|---|
| Polymer A | 10 | 10 | 0 | 17.7 |
| Dispersion A | 3 | 3 | 0 | 12.1 |
| Dispersion B | 5 | 5 | 0 | 14.1 |
| Dispersion C | 10 | 10 | 0 | 14.8 |

| Polymer Description | Cationic Mole% | DMAEA. MCQ Mole % | DMAEA. BCQ Mole % | IV 0.125N NO3 (dl/g) |
|---|---|---|---|---|
| Polymer A | 10 | 10 | 0 | 17.70 |
| Dispersion D | 10 | 10 | 0 | 17.00 |
| Dispersion E | 10 | 10 | 0 | 18.20 |
| Dispersion F | 20 | 20 | 0 | 21.20 |
| Dispersion G | 20 | 20 | 0 | 19.40 |

| Polymer Description | Cationic Mole% | DMAEA. MCQ Mole % | DMAEA. BCQ Mole % | IV 0.125N NO3 (dl/g) |
|---|---|---|---|---|
| Polymer A | 10 | 10 | 0 | 17.70 |
| Dispersion D | 10 | 10 | 0 | 17.00 |
| Dispersion E | 10 | 10 | 0 | 18.20 |
| Dispersion F | 20 | 20 | 0 | 21.20 |
| Dispersion G | 20 | 20 | 0 | 19.40 |

PAPERMAKING PROCESS UTILIZING HYDROPHILIC DISPERSION POLYMERS OF DIMETHYLAMINOETHYL ACRYLATE METHYL CHLORIDE QUATERNARY AND ACRYLAMIDE AS RETENTION AND DRAINAGE AIDS

This application is a continuation-in-part of U.S. Ser. No. 08/719,283, filed Sep. 24, 1996, by Jane B. Wong Shing and John R. Hurlock entitled "Hydrophilic Dispersion Polymers for Paper Applications now abandoned."

FIELD OF THE INVENTION

This invention relates generally to the field of papermaking and, more particularly, to an improved papermaking process utilizing hydrophilic dispersion copolymers of dialkylaminoalkyl (meth)acrylate quaternaries and (meth) acrylamide as retention and drainage aids.

BACKGROUND OF THE INVENTION

In the manufacture of paper, an aqueous cellulosic suspension or slurry is formed into a paper sheet. The cellulosic slurry is generally diluted to a consistency (percent dry weight of solids in the slurry) of less than 1 percent, and often below 0.5 percent, ahead of the paper machine, while the finished sheet must have less than 6 weight percent water. Hence, the dewatering aspects of papermaking are extremely important to the efficiency and cost of the manufacture.

The least costly dewatering method is drainage, and thereafter more expensive methods are used, including vacuum pressing, felt blanket blotting and pressing, evaporation and the like, and any combination of such methods. Because drainage is both the first dewatering method employed and the least expensive, improvements in the efficiency of drainage will decrease the amount of water required to be removed by other methods and improve the overall efficiency of dewatering, thereby reducing the cost thereof.

Another aspect of papermaking that is extremely important to the efficiency and cost of manufacture is the retention of furnish components on and within the fiber mat being formed during papermaking. A papermaking furnish contains particles that range in size from about the 2 to 3 millimeter size of cellulosic fibers to fillers measuring only a few microns. Within this range are cellulosic fines, mineral fillers (employed to increase opacity, brightness and other paper characteristics) and other small particles that generally, without the inclusion of one or more retention aids, would pass through the spaces (pores) between the cellulosic fibers in the fiber mat being formed.

One method of improving the retention of cellulosic fines, mineral fillers and other furnish components on the fiber mat is the use of a coagulant/flocculant system, which is added ahead of the paper machine. In such a system, a coagulant such as a low molecular weight cationic synthetic polymer or a cationic starch is first added to the furnish. The coagulant generally reduces the negative surface charges present on the particles in the furnish, particularly cellulosic fines and mineral fillers, and thereby agglomerates such particles. The coagulant is followed by the addition of a flocculant. The flocculant is generally a high molecular weight cationic or anionic synthetic polymer which bridges the particles and/or the agglomerates from one surface to another, thereby binding the particles into large agglomerates. The presence of such large agglomerates in the furnish increases retention. The agglomerates are filtered out of the water onto the fiber web, where unagglomerated particles would otherwise generally pass.

While a flocculated agglomerate generally does not interfere with the drainage of the fiber mat to the extent that would occur if the furnish were gelled or contained gelatinous material, when such flocs are filtered by the fiber web the pores thereof are reduced, thus reducing drainage efficiency. Hence, the retention is increased at the expense of a decrease in drainage.

Systems, such as those described in U.S. Pat. Nos. 4,753,710 and 4,913,775, the disclosures of which are incorporated herein by reference, have been employed to provide an improved combination of retention and dewatering. Briefly, these patents call for adding to the aqueous cellulosic papermaking suspension a high molecular weight linear cationic polymer before shearing the suspension, followed by the addition of bentonite after shearing. The shearing is generally provided by one or more of the cleaning, mixing and pumping stages of the papermaking process. The shearing breaks down the large flocs formed by the high molecular weight polymer into microflocs, and further agglomeration then ensues with the addition of the bentonite clay particles.

Another system, disclosed in U.S. Pat. No. 4,388,150, uses the combination of cationic starch followed by colloidal silica to increase the amount of material retained on the web by charge neutralization and adsorption of smaller agglomerates.

U.S. Pat. Nos. 5,098,520 and 5,185,062, the disclosures of which are incorporated herein by reference, describe methods of improving dewatering in a papermaking process.

Despite these prior art systems, there is still a need for new processes utilizing hydrophilic dispersion polymers to improve retention and drainage performance, especially without the unwanted addition of oils and surfactants which are contained in the conventional latex polymers. As used herein, "latex" is defined to mean an inverse water-in-oil emulsion polymer. There is also a need for dispersion polymers which can be easily diluted with water and introduced to the papermaking process using simple feeding equipment.

SUMMARY OF THE INVENTION

The method of the invention calls for forming an aqueous cellulosic papermaking slurry, adding an effective amount of a hydrophilic dispersion polymer to the slurry, draining the slurry to form a sheet and drying the sheet. The hydrophilic dispersion polymer comprises:

i. a cationic monomer of the formula

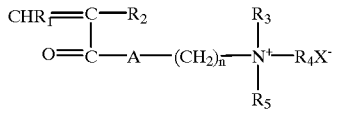

wherein $R_1$ and $R_2$ are selected from the group consisting of H and $CH_3$; $R_3$, $R_4$ and $R_5$ are selected from the group consisting of $CH_3$, $C_2H_5$ and $C_3H_7$; A is selected from the group consisting of an oxygen atom and NH; n is an integer from 1 to 4; and $X^-$ is an anionic counterion and ii. a second monomer of the formula

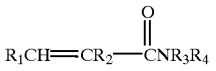

wherein $R_1$ is H and $R_2$, $R_3$ and $R_4$ are selected from the group consisting of H and $CH_3$, in an aqueous solution of a polyvalent anionic salt, wherein said polymerization is carried out in the presence of a dispersant.

This method improves retention and drainage performance without the unwanted addition of oils and surfactants. Moreover, the hydrophilic dispersion polymers utilized in the present invention can be easily diluted with water and introduced to the papermaking process using simple feeding equipment.

DETAILED DESCRIPTION OF THE INVENTION

Figure 1:
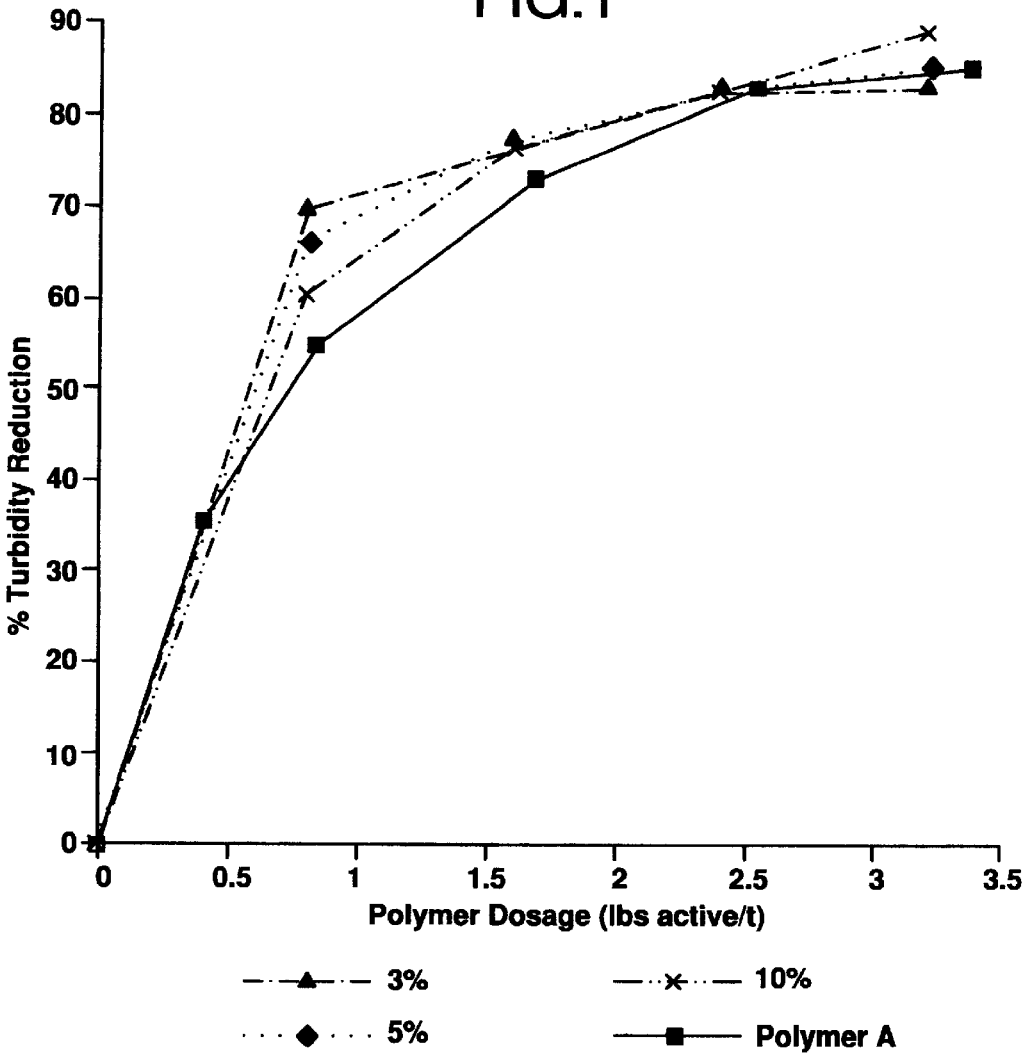
FIG. 1 shows a comparison between the turbidity reduction of three dispersion polymers and the standard latex retention aid.

The present invention is directed to a method for improving retention and drainage performance in a papermaking process which comprises forming an aqueous cellulosic papermaking slurry, adding a hydrophilic dispersion polymer to the slurry, draining the slurry to form a sheet and then drying the sheet.

The hydrophilic dispersion polymer of the invention is a copolymer of a dialkylaminoalkyl (meth)acrylate quaternary and (meth)acrylamide. A preferred copolymer is formed from dimethylaminoethyl acrylate methyl chloride quaternary (DMAEA.MCQ) and acrylamide (AcAm). It has been found that the polymer described above confers advantages for use in a papermaking process. Specifically, the hydrophilic dispersion polymers of the invention show improved or equal activity with respect to retention and drainage performance without the unwanted addition of oils and surfactants as compared to conventional cationic latex polymers. Additionally, these polymers require no inverter system and can be introduced to the papermaking process using simple feeding equipment.

Another advantage concerns the mode of addition of the dispersion polymers. In most cases, conventional water-soluble polymers are now commercially available in a powder form. Prior to use, the polymeric powder must be dissolved in an aqueous medium for actual application. The polymer swells in aqueous medium, and the dispersed particles flocculate. It is typically very difficult to dissolve the conventional polymers in an aqueous medium. By contrast, the dispersion polymers of this invention, by their nature, avoid dissolution-related problems.

Furthermore, the dispersion copolymers formed from DMAEA.MCQ and AcAm have the advantageous flexibility in that they may be used either as the sole polymeric treatment, or as a component in a conventional dual polymer program which requires both a conventional coagulant and a flocculant.

The dispersion copolymers of the present invention, if required in the form of an aqueous solution resulting from dilution with water, can be advantageously used in a number of technological fields as flocculating agents, thickeners, soil conditioners, adhesives, food additives, dispersants, detergents, additives for medicines or cosmetics, among others.

The Monomers

Examples 1 to 4 outline the process for preparing the copolymer at various ratios of the monomer components in the range of from about 1:99 to about 99:1 of acrylamide type monomer to dialkylaminoalkyl (meth)acrylate quaternary. Each of the two types of monomers utilized to form the dispersion polymers of this invention will be described below in greater detail.

However, briefly, a specific example of one applicable (meth)acrylate quaternary is DMAEA.MCQ. Preferably, the amount of DMAEA.MCQ present in the copolymer is from about 0.1 mole percent to about 30 mole percent. Dialkylaminoalkyl (meth)acrylate quaternaries, especially DMAEA.MCQ, are well-known and commercially available from a variety of sources.

As concerns the acrylamide-type monomers, applicable monomers include, but are not limited to, acrylamide, methacrylamide, N-methyl acrylamide and N-methyl methacrylamide.

The Polyvalent Anionic Salts

A polyvalent anionic salt is incorporated in an aqueous solution. According to the present invention, the polyvalent anionic salt is suitably a sulfate, a phosphate or a mixture thereof. Preferable salts include ammonium sulfate, sodium sulfate, magnesium sulfate, aluminum sulfate, ammonium hydrogen phosphate, sodium hydrogen phosphate and potassium hydrogen phosphate. In the present invention, these salts may be each used as an aqueous solution thereof having a concentration of 15% or above.

The Dispersant

A dispersant polymer is present in the aqueous anionic salt solution in which the polymerization of the above monomers occurs. The dispersant polymer is a water-soluble high molecular weight cationic polymer and is preferably soluble in the above-mentioned aqueous salt solution. It is preferred that the dispersant polymer be used in an amount of from about 1 to 10% by weight based on the total weight of the hydrophilic dispersion polymer.

The dispersant polymer is composed of 20 mole % or more of cationic monomer units of diallyl disubstituted ammonium halide or N,N-dialkyl-aminoethyl(meth) acrylates and their quaternary salts. Preferably, the residual mole % is AcAm or (meth)AcAm. The molecular weight of the dispersant is preferably in the range of about 10,000 to 10,000,000. Preferred dispersants include homopolymers of diallyldimethyl ammonium chloride, dimethylaminoethyl acrylate methyl chloride quaternary salt and dimethyl- aminoethyl methacrylate methyl chloride quaternary salt.

According to one embodiment of the invention, a multifunctional alcohol such as glycerin or polyethylene glycol is coexistent in the polymerization system. The deposition of the fine particles is smoothly carried out in the presence of these alcohols. Moreover, polysaccharides such as starch, dextran, carbomethoxy cellulose and pullulan, among others, can also be used as stabilizers either solely, or in conjunction with other organic cationic flocculants.

The Dispersion Polymers

For the polymerizations, a usual water-soluble radical-forming agent can be employed, but preferably water-soluble azo compounds such as 2,2'-azobis(2-amidinopropane) hydrochloride and 2,2'-azobis(N,N'-dimethyleneisobutylamine) hydrochloride are used.

According to one embodiment of the invention, a seed polymer is added before the beginning of the polymerization of the above monomers for the purpose of obtaining a fine dispersion. The seed polymer is a water-soluble cationic polymer insoluble in the aqueous solution of the polyvalent anion salt. The seed polymer is preferably a polymer prepared from the above monomer mixture by the process described herein. Nevertheless, the monomer composition of the seed polymer need not always be equal to that of the water-soluble cationic polymer formed during polymerization. However, like the water-soluble polymer formed during polymerization, the seed polymer should contain at least 5 mole percent of cationic monomer units of DMAEA.MCQ. According to one embodiment of the invention, the seed polymer used in one polymerization reaction is the water-soluble polymer prepared in a previous reaction which used the same monomer mixture.

The Method

An aqueous cellulosic slurry is first formed by any conventional means generally known to those skilled in the art. A hydrophilic dispersion polymer is next added to the slurry.

The hydrophilic dispersion polymer is formed by the polymerization of i. a cationic monomer of the formula

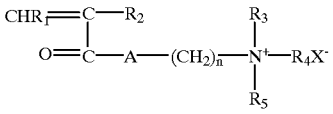

wherein $R_1$ and $R_2$ are selected from the group consisting of H and $CH_3$; $R_3$, $R_4$ and $R_5$ are selected from the group consisting of $CH_3$, $C_2H_5$ and $C_3H_7$; A is selected from the group consisting of an oxygen atom and NH; n is an integer from 1 to 4; and $X^-$ is an anionic counterion and ii. a second monomer of the formula

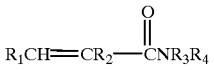

wherein $R_1$ is H and $R_2$, $R_3$ and $R_4$ are selected from the group consisting of H and $CH_3$, in an aqueous solution of a polyvalent anionic salt, wherein said polymerization is carried out in the presence of a dispersant.

The cellulosic papermaking slurry is next drained to form a sheet and then dried. The steps of draining and drying may be carried out in any conventional manner generally known to those skilled in the art.

The cationic monomer may be DMAEA.MCQ and the second monomer may be AcAm. The hydrophilic dispersion polymer may have a cationic charge of from about 0.1 mot % to about 30 mol %.

Additionally, conventional coagulants, conventional flocculants, alum, cationic starch or a combination thereof may also be utilized as adjuncts with the dispersion polymers, though it must be emphasized that the dispersion polymer does not require any adjunct for effective retention and drainage activity.

Furthermore, the range of intrinsic viscosities for the hydrophilic dispersion polymers of the invention is from about 0.5 to about 40 dl/g, preferably from about 5 to about 35 dl/g and most preferably from about 10 to about 30 dl/g for a 0.045% polymer in 1M $NaNO_3$. Depending upon the conditions at the particular mill, the preferred dose is from about 0.05 to about 5.0 pounds of active per ton of slurry solids.

The present method is believed to be applicable to all grades and types of paper products, and further applicable for use on all types of pulps including chemical pulps, sulfate and sulfite pulps from both hard and soft woods and acid pulps, thermomechanical pulps, mechanical pulps, recycle pulps and ground wood pulps. Typically, such furnishes will have a pH of from about 3.0 to about 9.0.

EXAMPLES

The following examples are intended to be illustrative of the present invention and to teach one of ordinary skill how to make and use the invention. These examples are not intended to limit the invention or its protection in any way.

Example 1

To a two-liter resin reactor equipped with strirrer, temperature controller, and water cooled condenser, were added 287.59 grams of a 48.1% solution of acrylamide (1.9461 moles), 7.24 grams of an 80.6% solution of DMAEA.MCQ (0.0301 moles), 250 grams of ammonium sulfate, 225.59 grams of deionized water, 27 grams of glycerol, 56.25 grams of a 16% solution of polyDADMAC (polydiallyldimethyl ammonium chloride)(IV=1.5 dl/gm), 18 grams of a 20% solution of polyDMAEA.MCQ (IV=2.0 dl/gm), and 0.3 grams of EDTA. The mixture was heated to 48° C. and 0.50 grams of a 4% solution of 2,2' azobis(2-amidinopropane) dihydrochloride were added. The resulting solution was sparged with 1000 cc/min. of nitrogen. After 15 minutes, polymerization began and the solution became viscous. Over the next 4 hours, the temperature was maintained at 48° C. and a solution containing 95.86 grams (0.6487 moles) of 48.1% acrylamide, 12.07 grams (0.0502 moles) of an 80.6% solution of DMAEA.MCQ, 9 grams of glycerol and 0.1 gram of EDTA was pumped into the reactor using a syringe pump. To the resulting polymer dispersion were added 0.50 grams of a 4% solution of 2,2' azobis(2-amidinopropane) dihydrochloride. The dispersion was then further reacted for 2.5 hours at a temperature of 48° C. to 55° C. The resulting polymer dispersion had a Brookfield viscosity of 5600cps. 10 grams of 99% acetic acid and 20 grams of sodium sulfate were added to the above dispersion. The resulting dispersion had a Brookfield viscosity of 1525 cps and contained 20% of a 97/3 copolymer of acrylamide and DMAEA.MCQ with an intrinsic viscosity of 12.1 dl/gm in 0.125 molar $NaNO_3$.

Example 2

To a two-liter resin reactor equipped with strirrer, temperature controller, and water cooled condenser, were added 281.68 grams of a 48.1% solution of acrylamide (1.9061 moles), 12.07 grams of an 80.6% solution of DMAEA.MCQ (0.05023 moles), 250 grams of ammonium sulfate, 225.10 grams of deionized water, 27 grams of glycerol, 33.75 grams of a 16% solution of polyDADMAC (IV=1.5 dl/gm), 36 grams of a 20% solution of polyDMAEA.MCQ (IV=2.0 dl/gm), and 0.3 grams of EDTA. The mixture was heated to 48° C. and 0.50 grams of a 4% solution of 2,2' azobis(2-amidinopropane) dihydrochloride were added. The resulting solution was sparged with 1000 cc/min. of nitrogen. After 15 minutes, polymerization began and the solution became viscous. Over the next 4 hours the temperature was maintained at 48° C. and a solution containing 93.89 grams (0.6354 moles) of 48.1% acrylamide, 20.11 grams (0.08368 moles) of an 80.6% solution of DMAEA.MCQ, 9 grams of glycerol and 0.1 grams of EDTA was pumped into the reactor using a syringe pump. To the resulting polymer dispersion were added 0.50 grams of a 4% solution of 2,2' azobis(2-amidinopropane) dihydrochloride. The dispersion was then further reacted for 2.5 hours at a temperature of 48° C. to 55° C. The resulting polymer dispersion had a Brookfield viscosity of 10000 cps. 10 grams of 99% acetic acid and 20 grams of sodium sulfate were added to the above dispersion. The resulting dispersion had a Brookfield viscosity of 2825 cps and contained 20% of a 95/5 copolymer of acrylamide and DMAEA.MCQ with an intrinsic viscosity of 14.1 dl/gm in 0.125 molar $NaNO_3$.

Example 3

To a two-liter resin reactor equipped with stirrer, temperature controller, and water cooled condenser, were added 239.38 grams of a 48.1% solution of acrylamide (1.6199 moles), 21.63 grams of an 80.6% solution of DMAEA.MCQ (0.09001 moles), 260 grams of ammonium sulfate, 258.01 grams of deionized water, 18 grams of glycerol, 33.75 grams of a 16% solution of polyDADMAC (IV=1.5 dl/gm), 36 grams of a 20% solution of polyDMAEA.MCQ (IV=2.0 dl/gm), and 0.3 grams of EDTA. The mixture was heated to 48° C. and 0.50 grams of a 4% solution of 2,2' azobis(2-amidinopropane) dihydrochloride were added. The resulting solution was sparged with 1000 cc/min. of nitrogen. After 15 minutes, polymerization began and the solution became viscous. Over the next 4 hours the temperature was maintained at 48° C. and a solution containing 79.79 grams (0.5399 moles) of 48.1% acrylamide, 36.04 grams (0.1500 moles) of an 80.6% solution of DMAEA.MCQ, 6 grams of glycerol and 0.1 gram of EDTA was pumped into the reactor using a syringe pump. To the resulting polymer dispersion were added 0.50 grams of a 4% solution of 2,2' azobis(2-amidinopropane) dihydrochloride. The dispersion was then further reacted for 2.5 hours at a temperature of 48° C. to 55° C. The resulting polymer dispersion had a Brookfield viscosity of 7600cps. 10 grams of 99% acetic acid and 20 grams of sodium sulfate were added to the above dispersion. The resulting dispersion had a Brookfield viscosity of 2100 cps and contained 20% of a 90/10 copolymer of acrylamide and DMAEA.MCQ with an intrinsic viscosity of 15.5 dl/gm in 0.125 molar $NaNO_3$.

Example 4

To a two-liter resin reactor equipped with strirrer, temperature controller, and water cooled condenser, were added 136.03 grams of a 48.1% solution of acrylamide (0.9205 moles), 37.12 grams of an 80.6% solution of DMAEA.MCQ (0.1545 moles), 190 grams of ammonium sulfate, 50 grams of sodium sulfate, 267.99 grams of deionized water, 13.2 grams of glycerol, 33.75 grams of a 16% solution of polyDADMAC (IV=1.5 dl/gm), 45 grams of a 20% solution of polyDMAEA.MCQ (IV=2.0 dl/gm), and 0.2 grams of EDTA. The mixture was heated to 48° C. and 0.50 grams of a 4% solution of 2,2' azobis(2-amidinopropane) dihydrochloride were added. The resulting solution was sparged with 1000 cc/min. of nitrogen. After 15 minutes, polymerization began and the solution became viscous. Over the next 4 hours the temperature was maintained at 48° C. and a solution containing 111.29 grams of 48.1% acrylamide, 63.47 grams (0.2641 moles) of an 80.6% solution of DMAEA.MCQ, 10.8 grams of glycerol and 0.2 grams of EDTA was pumped into the reactor using a syringe pump. To the resulting polymer dispersion were added 0.50 grams of a 4% solution of 2,2' azobis(2-amidinopropane) dihydrochloride. The dispersion was then further reacted for 2.5 hours at a temperature of 48° C. to 55° C. The resulting polymer dispersion had a Brookfield viscosity of 2160 cps. 10 grams of 99% adipic acid and 30 grams of ammonium sulfate were added to the above dispersion. The resulting dispersion had a Brookfield viscosity of 1325 cps and contained 20% of an 80/20 copolymer of acrylamide and DMAEA.MCO with an intrinsic viscosity 13.7 dl/gm in 0.125 molar $NaNO_3$.

The polymers used in this invention and their respective descriptions are summarized in Table I.

TABLE I

| Dispersions | | |
|---|---|---|
| Dispersion A[1] | 3 mole % DMAEA.MCQ | IV 12.1 dl/g |
| Dispersion B[2] | 5 mole % DMAEA.MCQ | IV 14.1 dl/g |
| Dispersion C[3] | 10 mole % DMAEA.MCQ | IV 14.8 dl/g |
| Dispersion D[3] | 10 mole % DMAEA.MCQ | IV 17.0 dl/g |
| Dispersion E[3] | 10 mole % DMAEA.MCQ | IV 18.2 dl/g |
| Dispersion F[4] | 20 mole % DMAEA.MCQ | IV 21.2 dl/g |
| Dispersion G[4] | 20 mole % DMAEA.MCQ | IV 19.4 dl/g |
| Other Polymers[5] | | |
| Polymer A[5] | 10 mole % DMAEA.MCQ Latex | IV 17.7 dl/g |
| Polymer B[5] | 10 mole % DMAEA.MCQ Latex | IV 19.1 dl/g |
| Polymer C[5] | 10 mole % DMAEA.BCQ Dispersion | IV 12.9 dl/g |
| Polymer D[5] | 70/30 mole % AcAm/NaAc Latex | |
| Polymer E[6] | 10 mole % DMAEA.MCQ Dry polymer | |

[1]Synthesized according to Example 1
[2]Synthesized according to Example 2
[3]Synthesized according to Example 3
[4]Synthesized according to Example 4
[5]Conventional treatment, available from Nalco Chemical Company of Naperville, IL
[6]Dry polymer available from Chemtall of Riceboro, GA

Drainage and Retention Tests

The following were utilized in Examples 5 through 7:

The Britt CF Dynamic Drainage jar was used for uniform mixing of polymer and furnish. The mixing speed of the Britt jar was 500 rpm.

Drainage and turbidity data were obtained for dispersion and latex polymers using the Alchem Drainage Tester. Retention was measured by the percent reduction in the turbidity obtained with no polymer treatment (blank). Dosage curves of Drainage Improvement (%) and Turbidity Reduction (%) were determined for the polymers tested.

Example 5

The initial activity tests of the DMAEA.MCQ dispersion polymers were done with 100% recycled linerboard. This furnish contained no added filler and retention was primarily for fines from the fiber. FIG. 1 shows a plot of % turbidity reduction versus polymer dosage for three of the hydrophilic dispersion polymers and Polymer A, a standard latex flocculent. The compositions of the dispersions were (1) AcAm/DMAEA.MCQ:97/3, (2) AcAm/DMAEA.MCQ:95/5, and (3) AcAm/DMAEA.MCQ:90/10 (Dispersions A, B and C, respectively). Dispersions A, B and C showed increased efficiency of retention performance as compared to Polymer A. In addition, FIG. 1 shows that turbidity reductions between 60 and 70% were achieved with the dispersion polymers at a dosage of approximately 0.8 lbs active/t.

Figure 2:
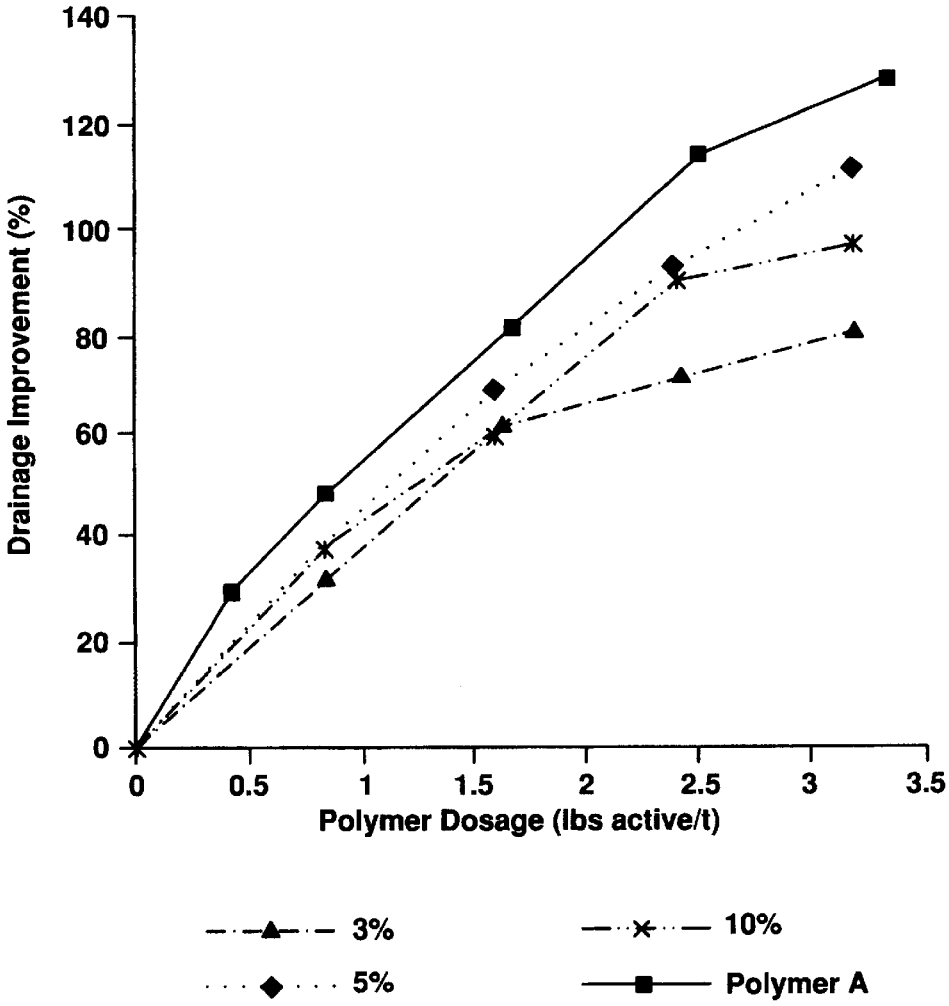
FIG. 2 shows a comparison between the drainage activity of three dispersion polymers and the standard latex retention aid.

FIG. 2 shows the drainage improvements realized by the dispersion polymers described above. The copolymer containing 5 mole % DMAEA.MCQ showed the best drainage behavior among the dispersions. Although the latex polymer, Polymer A, outperformed the dispersions for the entire dosage range tested, it should be noted that the intrinsic viscosities of the first batches of hydrophilic dispersions were significantly lower than Polymer A.

Example 6

The corrugated coated furnish was a mixture of OCC, newsprint and boxboard. Unlike the recycled linerboard this furnish contained $CaCO_3$ as filler. The percent ash was found by gravimetric measurement to be 7.3%. Preliminary activity testings were carried out with the lower IV (11.9–15.7 dl/g) polymer samples and the data indicated some important trends in polymer performances. Both retention and drainage performances of the dispersion polymers improved with increasing mole % of DMAEA.MCQ. Overall, the 10 mole % DMAEA.MCQ copolymer demonstrated the best drainage and retention performances among the dispersions tested.

Figure 3:
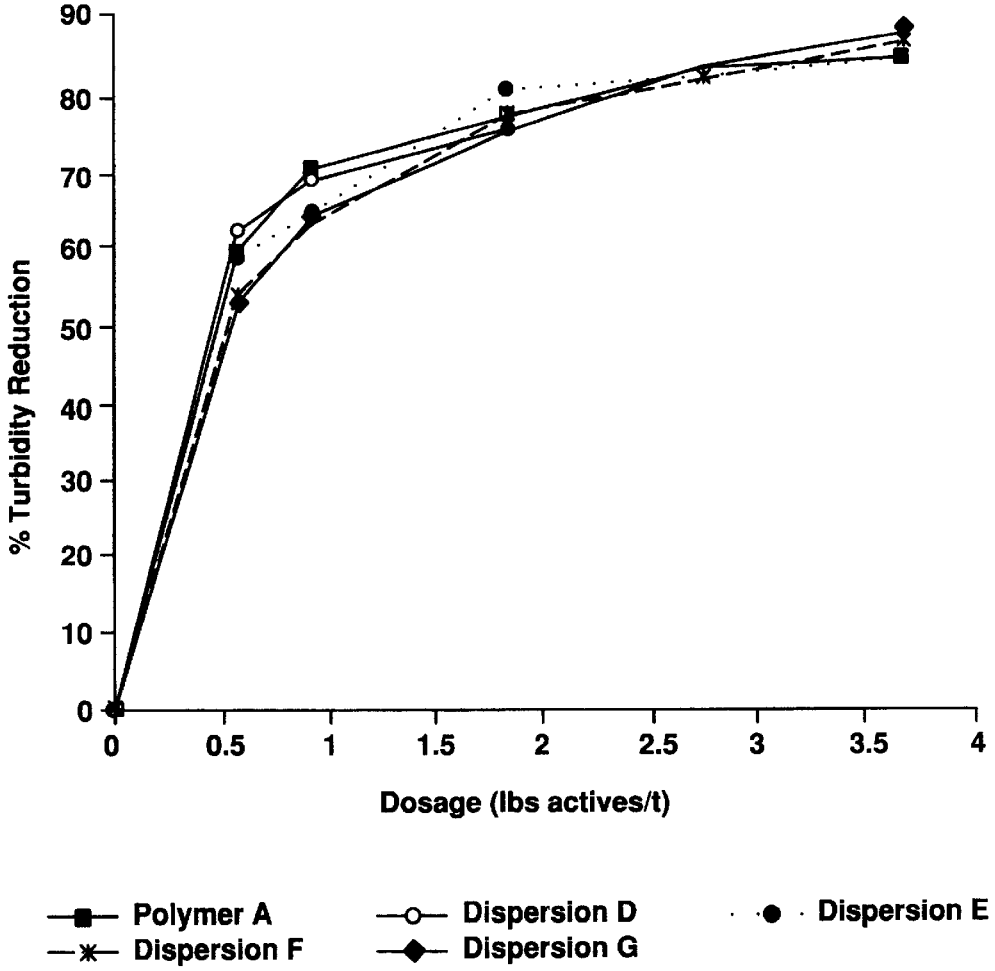
FIG. 3 shows a comparison between the retention activity of higher intrinsic viscosity dispersion copolymers containing 10 and 20 mole % DMAEA.MCQ.

The retention performances of the higher IV (17.0–21.2 dl/g) dispersion copolymers containing 10 and 20 mole % DMAEA.MCQ are shown in FIG. 3. Dispersions D, E, F and G, containing 10 and 20 mole% DMAEA.MCQ, showed comparable retention activities to Polymer A with corrugated coated furnish.

Figure 4:
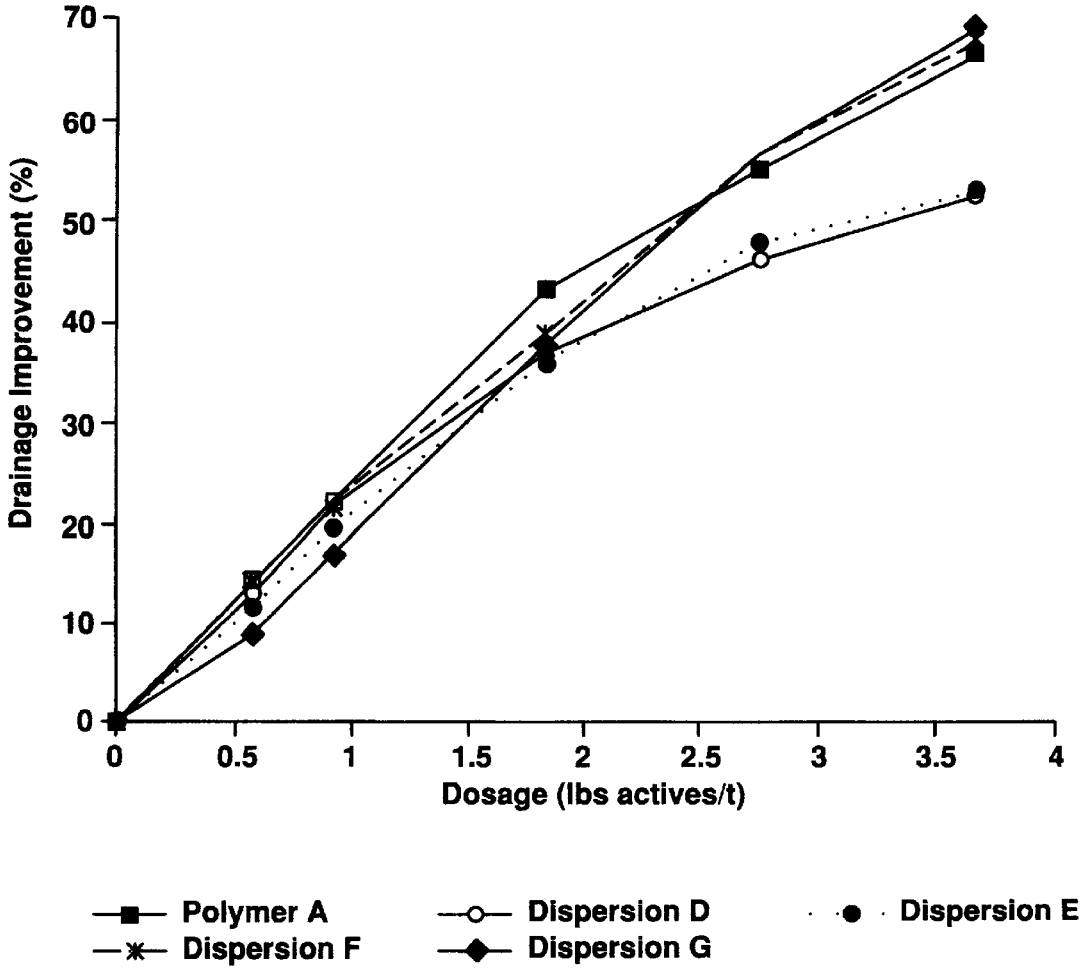
FIG. 4 shows a comparison between the drainage activity of higher intrinsic viscosity dispersion co-polymers containing 10 and 20 mole % DMAEA.MCQ.

FIG. 4 shows the drainage activities of the higher IV dispersion copolymers containing 10 and 20 mole % DMAEA.MCQ. The results clearly demonstrate that for the dosage range of 0 to 1.5 lbs active/t, the hydrophilic dispersion polymers were comparable to the standard flocculant, Polymer A. As the polymer dosage was increased to 4.0 lbs active/t, the 20 mole % DMAEA.MCQ copolymers continued to show drainage behavior similar to Polymer A.

Example 7

Figure 5:
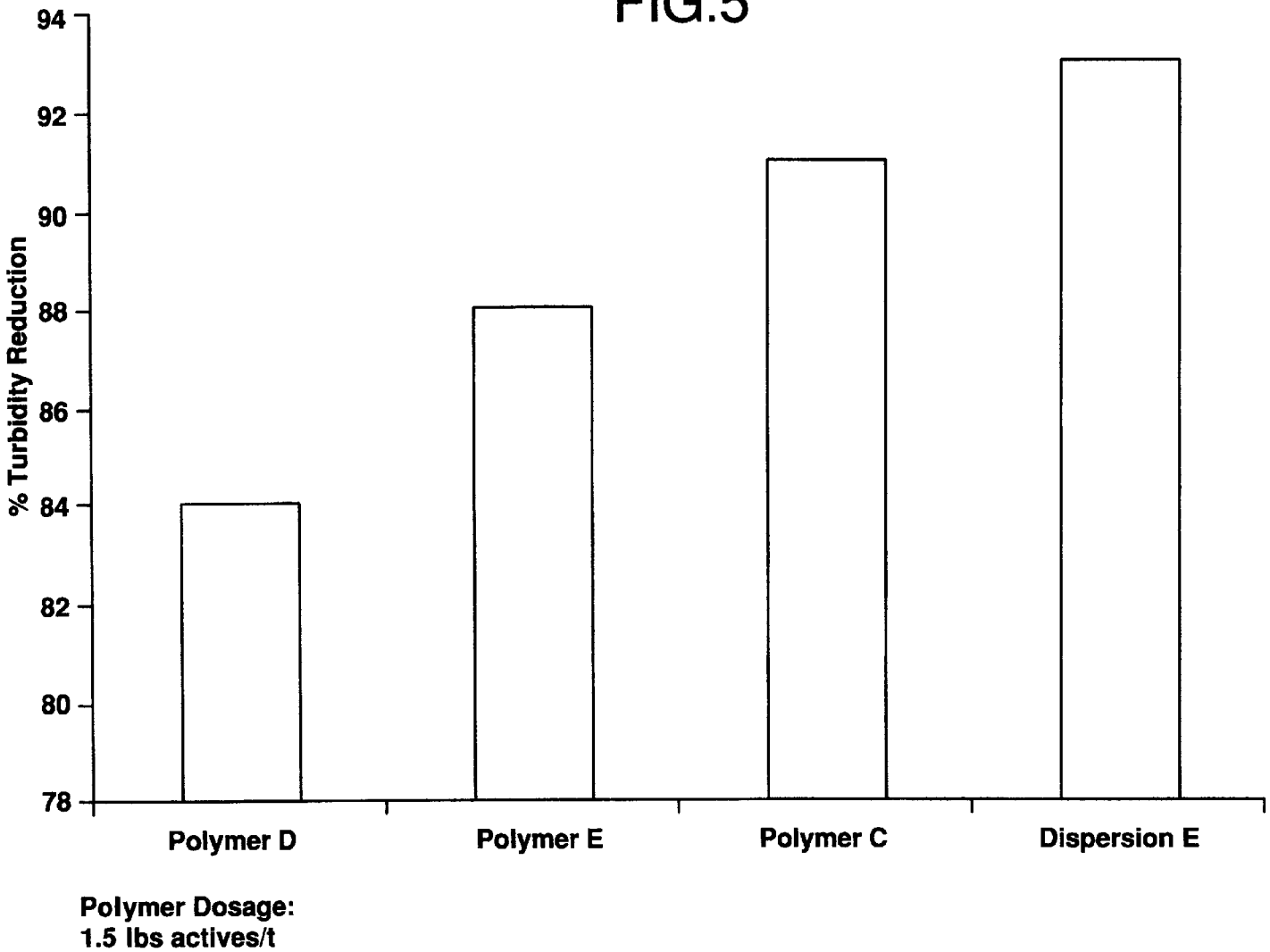
FIG. 5 shows a comparison between the retention performance of dispersion latex and dry polymers.

The publication grade furnish was a blend of 90% (softwood, hardwood, high ash broke, low ash broke) and 10% ($CaCO_3$, $TiO_2$, starch, alum). The flocculant used at the time of the test was Polymer D (AcAm/NaAc:70/30). FIG. 5 shows the results of Britt jar screening of dispersion and dry polymers. On an equal actives basis at 1.5 lbs/t, the 10 mole % DMAEA.MCQ dispersion (Dispersion E) outperformed Polymers C, D and E.

While the present invention is described above in connection with preferred or illustrative embodiments, these embodiments are not intended to be exhaustive or limiting of the invention. Rather, the invention is intended to cover all alternatives, modifications and equivalents included within its spirit and scope, as defined by the appended claims.

What is claimed is:

1. A method for improving retention and drainage performance in a papermaking process comprising the steps of:

a) forming an aqueous cellulosic papermaking slurry;

b) adding an effective amount of a hydrophilic dispersion polymer to the slurry wherein the hydrophilic dispersion polymer results from the polymerization of monomers, the monomers selected from the group consisting of:

i. a cationic monomer of the formula

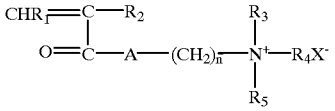

wherein $R_1$ and $R_2$ are selected from the group consisting of H and $CH_3$; $R_3$, $R_4$ and $R_5$ are selected from the group consisting of $CH_3$, $C_2H_5$ and $C_3H_7$; A is selected from the group consisting of an oxygen atom and NH; n is an integer from 1 to 4; and $X^-$ is an anionic counterion and ii. a second monomer of the formula

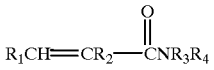

wherein $R_1$ is H and $R_2$, $R_3$ and $R_4$ are selected from the group consisting of H and $CH_3$, in an aqueous solution of a polyvalent anionic salt, wherein said polymerization is carried out in the presence of a dispersant;

c) draining the slurry to form a sheet; and d) drying the sheet.

2. The method of claim 1 wherein the cationic monomer is dimethylaminoethyl acrylate methyl chloride quaternary and the second monomer is acrylamide.

3. The method of claim 1 wherein the hydrophilic dispersion polymer has a cationic charge of from about 0.1 mol % to about 30 mol %.

4. The method of claim 1 wherein the hydrophilic dispersion polymer has an intrinsic viscosity of from about 0.5 to about 40 deciliters per gram.

5. The method of claim 1 wherein the hydrophilic dispersion polymer has an intrinsic viscosity of from about 5 to about 35 deciliters per gram.

6. The method of claim 1 wherein the hydrophilic dispersion polymer has an intrinsic viscosity of from about 10 to about 30 deciliters per gram.

7. The method of claim 1 wherein the dispersion polymer is added in an amount of from about 0.05 to about 5.0 pounds of active per ton of slurry solids.

8. The method of claim 1 further comprising addition of a coagulant in step b).

9. The method of claim 1 further comprising the addition of a flocculant in step b).

10. The method of claim 1 further comprising the addition of alum in step b).

11. The method of claim 8 further comprising the addition of alum in step b).

12. The method of claim 9 further comprising the addition of alum in step b).

13. The method of claim 1 further comprising the addition of a cationic starch in step b).

14. The method of claim 8 further comprising the addition of a cationic starch in step b).

15. The method of claim 9 further comprising the addition of a cationic starch in step b).

16. A method for improving retention and drainage performance in a papermaking process comprising the steps of:

a) forming an aqueous cellulosic papermaking slurry;

b) adding an effective amount of a hydrophilic dispersion polymer to the slurry wherein the hydrophilic dispersion polymer results from the polymerization of monomers, the monomers selected from the group consisting of:

i. a cationic monomer of the formula

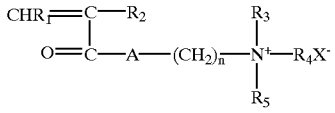

wherein $R_1$ and $R_2$ are selected from the group consisting of H and $CH_3$; $R_3$ and $R_5$ are selected from the group consisting of $CH_3$, $C_2H_5$ and $C_3H_7$; $R_4$ is $CH_3$; A is selected from the group consisting of an oxygen atom and NH; n is an integer from 1 to 4; and $X^-$ is an anionic counterion and ii. acrylamide or methacrylamide, in an aqueous solution of a polyvalent anionic salt, wherein said polymerization is carried out in the presence of a dispersant;

c) draining the slurry to form a sheet; and d) drying the sheet.

* * * * *

UNITED STATES PATENT AND TRADEMARK OFFICE

CERTIFICATE OF CORRECTION

PATENT NO. : 6,059,930
DATED : May 9, 2000
INVENTOR(S) : Jane B. Wong Shing and John R. Hurlock It is certified that error appears in the above-identified patent and that said Letters Patent is hereby corrected as shown below:

Column 10,
Lines 33, 35, 38, 41, 44, 47, 50, 52, 54 and 60 should read as -- The method of claim 16 --

Signed and Sealed this

Twenty-eighth Day of May, 2002

*Attest:*

*Attesting Officer*

JAMES E. ROGAN
*Director of the United States Patent and Trademark Office*